US009878841B2

(12) United States Patent
Holderness et al.

(10) Patent No.: US 9,878,841 B2
(45) Date of Patent: Jan. 30, 2018

(54) HEAVY DUTY INSULATED BEVERAGE DISPENSER AND COOLER

(71) Applicant: High Performance Coolers LLC, Florence, KY (US)

(72) Inventors: Stephen Holderness, Florence, KY (US); Robert Joseph Cicero, Union, KY (US)

(73) Assignee: High Performance Coolers LLC, Florence, KY (US)

( * ) Notice: Subject to any disclaimer, the term of this patent is extended or adjusted under 35 U.S.C. 154(b) by 0 days.

(21) Appl. No.: 14/752,034

(22) Filed: Jun. 26, 2015

(65) Prior Publication Data

US 2015/0375918 A1 Dec. 31, 2015

Related U.S. Application Data

(60) Provisional application No. 62/018,242, filed on Jun. 27, 2014.

(51) Int. Cl.
*B65D 83/00* (2006.01)
*B65D 81/38* (2006.01)
(Continued)

(52) U.S. Cl.
CPC ..... *B65D 81/3823* (2013.01); *B65D 83/00* (2013.01); *B67D 3/0067* (2013.01); *A45C 11/20* (2013.01); *A45C 13/30* (2013.01); *A47G 23/04* (2013.01); *B65D 25/102* (2013.01); *B67D 2210/00044* (2013.01); *F25D 3/08* (2013.01);
(Continued)

(58) Field of Classification Search
CPC . F25D 3/06; F25D 3/08; F25D 29/006; F25D 2331/806; A45C 11/20; A45C 13/30; B65D 81/3823; B65D 81/3818; B65D 83/00; B65D 25/102; B65D 45/16; B65D 43/16; A47G 23/04; A47K 1/05; F22B 37/24; B67D 3/0067
USPC ..... 62/389–400, 371–372, 457.1, 457.2; 220/592.01–592.28, 476–483, 567.3, 730, 220/915.1–915.2; 222/185.1, 146.6, 222/465.1–475.1; 248/505, 146; 224/402–404, 42.11
See application file for complete search history.

(56) References Cited

U.S. PATENT DOCUMENTS 1,047,941 A * 12/1912 Hollingsworth ..... A45C 13/262 190/115
1,843,055 A * 1/1932 Weinstein ..... F25D 3/14 215/6
(Continued)

*Primary Examiner* — Paul R Durand
*Assistant Examiner* — Andrew P Bainbridge
(74) *Attorney, Agent, or Firm* — Wood Herron & Evans LLP

(57) ABSTRACT

Disclosed is an insulated beverage dispenser having a generally cube-shaped insulated body with an interior chamber, an open top, and an outlet adjacent a bottom of the interior chamber. It includes a removable closure member for the outlet and an insulated top hingedly connected to the body to close the open top. A guideway is located on a front outer surface of the body generally adjacent the open top and is sized and positioned to receive a securement strap extended across the body without interference with opening the top. The closure member can be a liquid dispensing valve and/or a plug. An interior surface of the lid may include a recess for receiving a spare closure member for the outlet.

10 Claims, 6 Drawing Sheets

(51) Int. Cl.

| | |
|---|---|
| ***B67D 3/00*** | (2006.01) |
| *B65D 25/10* | (2006.01) |
| *F25D 3/08* | (2006.01) |
| *F25D 29/00* | (2006.01) |
| *A45C 11/20* | (2006.01) |
| *A45C 13/30* | (2006.01) |
| *A47G 23/04* | (2006.01) |

(52) U.S. Cl.
CPC ..... *F25D 29/006* (2013.01); *F25D 2331/806* (2013.01)

(56) References Cited

U.S. PATENT DOCUMENTS 2,613,847 A * 10/1952 Lacher ..... A45C 13/38 220/754
3,069,869 A 12/1962 Mueller
3,282,068 A * 11/1966 Cain ..... F25D 3/08 165/46
4,068,779 A * 1/1978 Canfield ..... B65D 25/28 16/428
4,281,520 A * 8/1981 Norwood ..... F25D 3/08 62/372
4,454,944 A * 6/1984 Shillington ..... A61B 50/362 206/366
4,629,153 A * 12/1986 Marcum ..... A47G 23/0266 108/46
4,955,957 A * 9/1990 Homes ..... A45C 11/20 220/324
5,046,529 A * 9/1991 Corella ..... E03B 11/06 137/216.1
5,746,405 A * 5/1998 Dvorak ..... F24H 9/06 248/146
5,927,557 A * 7/1999 Busick ..... B67D 1/0835 137/329.1
6,244,458 B1 * 6/2001 Frysinger ..... B65D 81/3823 220/592.09
6,254,051 B1 * 7/2001 Hubbard ..... F24H 9/06 126/24
6,280,128 B1 * 8/2001 Schrader ..... B60R 9/0485 410/102
6,349,906 B1 * 2/2002 Anderson ..... B67D 3/0029 248/146
7,309,106 B2 * 12/2007 Stallman ..... A47C 15/004 297/188.09
7,328,818 B2 * 2/2008 Prabucki ..... B67D 3/0029 222/146.6
7,481,065 B2 * 1/2009 Krieger ..... F25B 21/04 62/3.6
8,875,934 B2 * 11/2014 Deka ..... B65D 81/3823 220/23.88
2003/0089724 A1 * 5/2003 Kawasumi ..... F25D 23/063 220/592.25
2006/0021201 A1 * 2/2006 Brown ..... A44B 11/06 24/298
2006/0065655 A1 * 3/2006 Taylor ..... A45C 7/0036 220/6
2006/0237927 A1 * 10/2006 Vanderberg ..... B62B 3/003 280/35
2007/0001409 A1 * 1/2007 Kaplan ..... A45C 9/00 280/35
2007/0154276 A1 7/2007 Dollar
2008/0149048 A1 * 6/2008 Ostler ..... F22D 1/003 122/510
2008/0302126 A1 * 12/2008 Falkenberg ..... F25D 3/08 62/457.1
2009/0241584 A1 10/2009 Hayes et al.
2010/0212351 A1 * 8/2010 Chapin ..... F25D 3/08 62/457.5
2012/0041347 A1 * 2/2012 Gammons ..... A61F 7/02 601/15
2013/0062356 A1 * 3/2013 Deka ..... F25D 3/14 220/592.25
2013/0207359 A1 * 8/2013 Vanderberg ..... A45C 5/146 280/30
2014/0252010 A1 * 9/2014 Miller ..... F25D 17/047 220/592.2
2015/0375918 A1 * 12/2015 Holderness ..... B65D 83/00 222/566

* cited by examiner

HEAVY DUTY INSULATED BEVERAGE DISPENSER AND COOLER

RELATED APPLICATION

This applications claims the benefit of and priority to U.S. Provisional Patent Application No. 62/018,242 filed Jun. 27, 2014, the entire contents and disclosure of which is incorporated herein by reference.

TECHNICAL FIELD

This invention relates to an insulated beverage dispenser and cooler constructed in a particular way to enhance its durability and utility.

BACKGROUND OF THE INVENTION

Large insulated beverage dispensers having a spigot and removable lid are known in order to provide bulk quantities of cold refreshment beverage, such as water, to a group of people or workers. Prior designs lack the durability and compact design necessary to make them suitable for extreme conditions or situations where failure could have catastrophic consequences.

SUMMARY OF THE INVENTION

The present invention provides an insulated beverage dispenser with a generally cube-shaped insulated body having an interior chamber, an open top, and an outlet adjacent a bottom of the interior chamber. It includes a removable closure member for the outlet and an insulated top hingedly connected to the body to close the open top. A guideway is provided on a front outer surface of the body generally adjacent the open top that is sized and positioned to receive a securement strap extended across the body without interference with opening the top.

The closure member may be a liquid dispensing valve and/or an interchangeable plug. An interior surface of the lid may include at least one recess for receiving a spare closure member for the outlet. The body may include first and second opposite tie-down passageways.

The lid can include lid latches positioned to secure the lid in a closed position and may include a plurality of exterior edge notches positioned to guide a tie-down strap extended across the lid. The lid latches can extend over the guideway.

The insulated beverage dispenser can include left and right opposite carry handles that are integral with the body and/or have a movable gripping portion that is extendable to a position above the lid.

Further features, aspects, benefits, and objects of the present invention may be apparent to a person skilled in the art upon examination of the following detailed description and various figures of the drawing.

BRIEF DESCRIPTION OF THE DRAWINGS

Like reference numerals are used to indicate like parts throughout the various figures of the drawings, wherein.

DETAILED DESCRIPTION OF THE INVENTION

Figure 1:
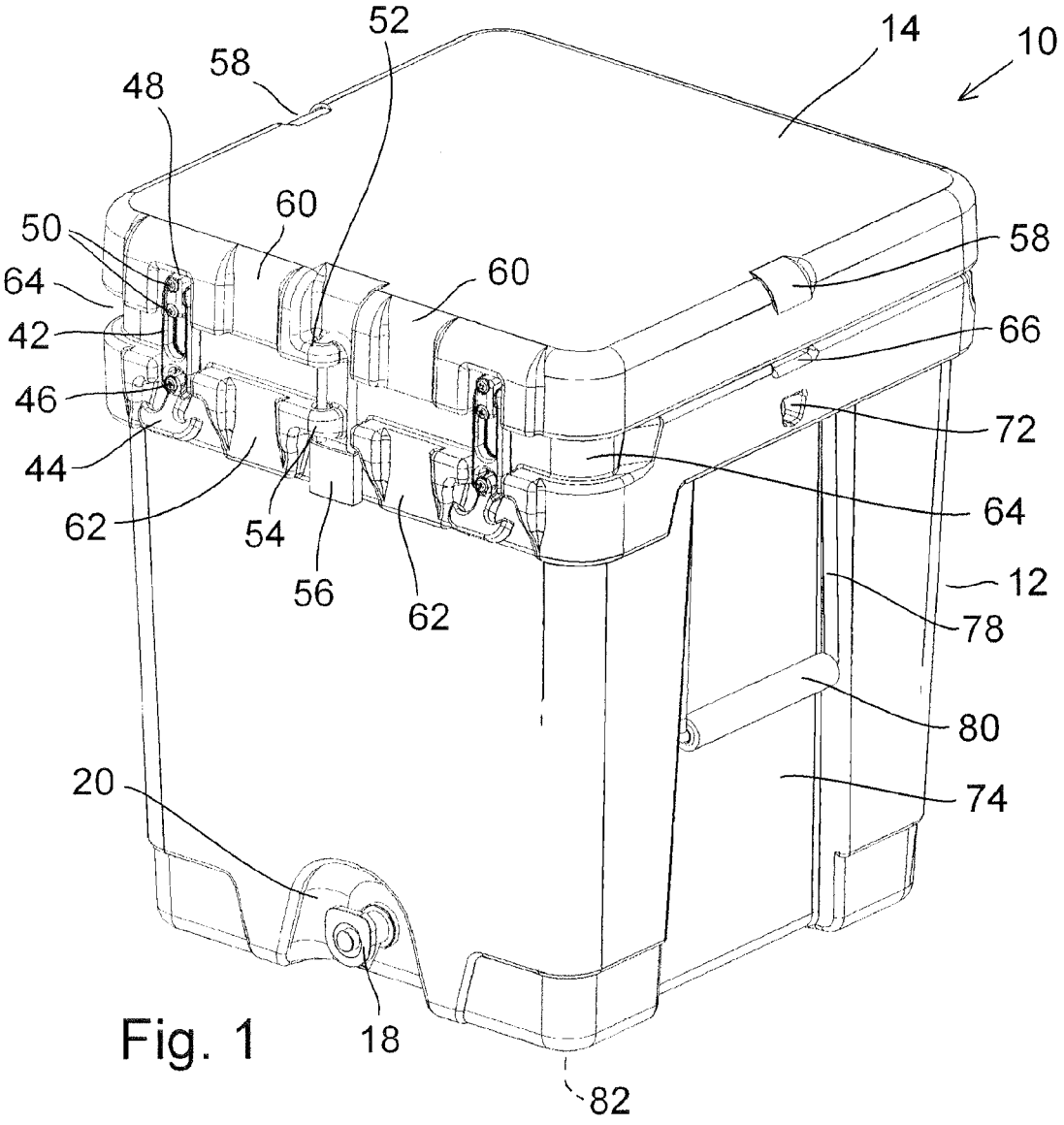
FIG. 1 is an isometric view of a first embodiment of a heavy duty insulated beverage dispenser according to one embodiment of the present invention.
Figure 2:
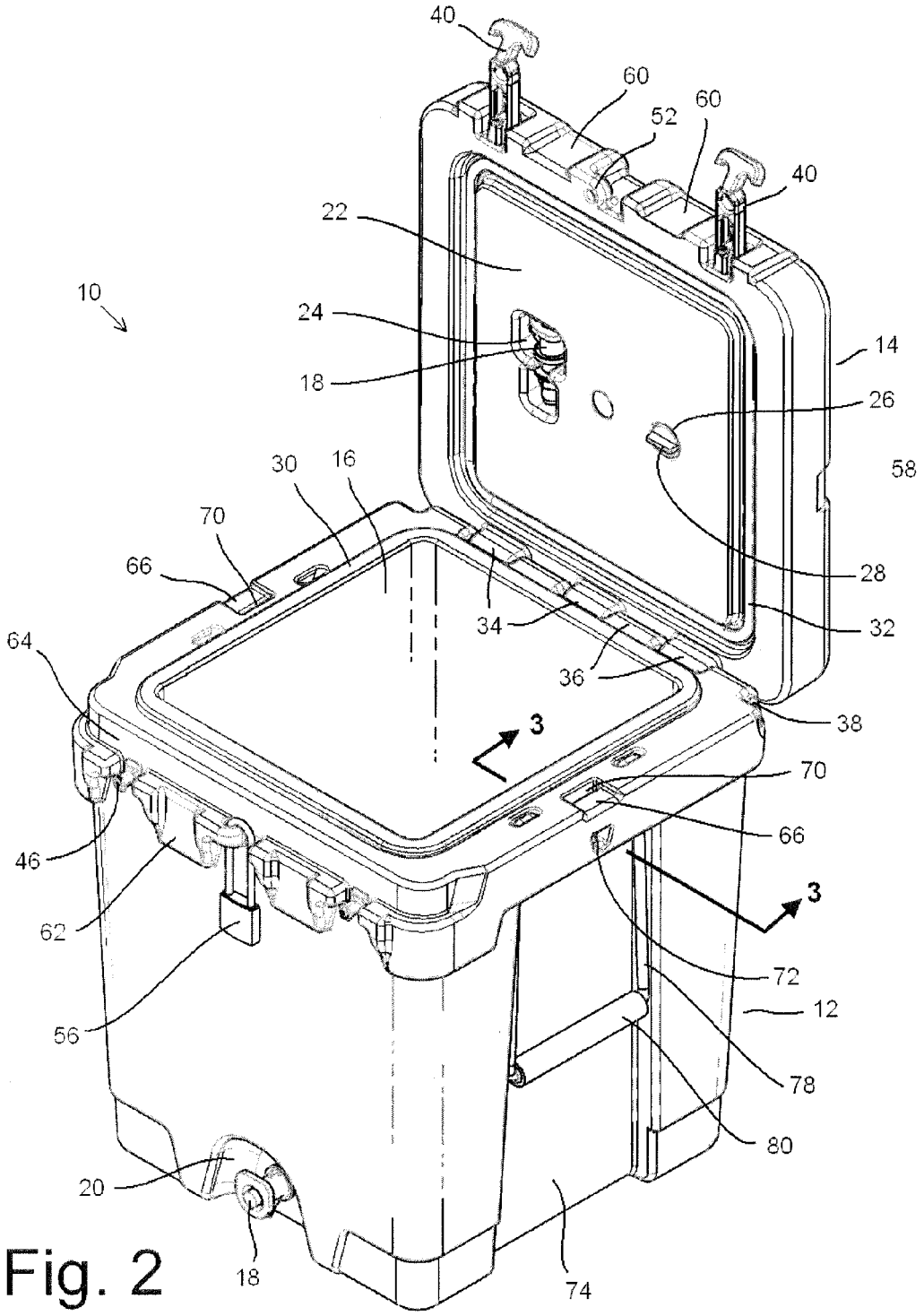
FIG. 2 is an isometric view thereof with the lid in an open position.

Referring now to the various figures of the drawing, and first to FIGS. 1 and 2, therein is shown at 10 a heavy duty insulated beverage dispenser and cooler unit according to a first embodiment of the invention. The illustrated unit 10 may be sized, for example, to hold approximately 40 quarts of liquid volume. In general terms, the unit 10 includes a body 12 and a lid 14 which may be pivotally attached to the body 12 by a hinge. The body 12 includes a hollow interior chamber 16. Hot or cold liquid put in the chamber 16 may be drained through an ordinary push-button spigot or valve 18 that is in fluid communication with the interior chamber 16.

The body 12 and lid 14 have spaced apart interior and exterior walls made of a durable moldable material, such as rotomolded compounded polyethylene. The space between the interior and exterior walls may be filled with an insulating material, such as polyurethane foam. The primary purpose of the unit 10 may be keeping liquids hot or cold for extended periods of time, which may be dispensed as needed through the valve 18. A large top opening allows ice to be dumped into or from the chamber 16 with ease.

According to one feature of the invention, the dispensing valve 18 may be situated in a recess 20 so that the valve 18 does not protrude beyond the front and bottom profile of the body 12. In this way, the valve 18 is protected from damage. The overall shape of the unit 10 may be relatively square, providing improved security and stability during transport of the container, while maximizing the interior capacity of the unit 10 relative to its footprint or profile. In other words, multiple units 10 or other containers, such as tool boxes, can be stacked together or placed adjacent one another with minimal wasted space compared to the common cylindrical shape found in other insulated beverage dispensers.

According to another feature of the invention, the interior wall 22 of the lid 14 may include one or more recesses 24, 26 for removably holding spare or alternative parts. For example, a first recess 24 may be sized and shaped to receive and hold a spare valve 18 for use in the event the other valve 18 fails or becomes damaged. Additionally, a second recess 26 may be sized and shaped to receivably hold a plug 28, which may be used to replace the valve 18 in the event the unit 10 is to be used as an insulated cooler rather than a beverage dispenser. Common dispenser valves 18 engage an opening in the dispenser with a threaded connection. A threaded plug 28 may be conveniently held in place by providing corresponding threads in the second recess 26.

Referring now in particular to FIG. 2, the upper edge of the body 12 may be provided with a raised annular lip or ridge 30 positioned to confront a correspondingly positioned elastomeric seal 32 installed on the interior wall 22 of the lid 12. Accordingly, the unit 10 may be provided with a water tight seal such that liquids in the interior chamber 16 will not escape even if the unit 10 is tipped or inverted.

The lid 14 may be hinged to the body 12 along a rear upper edge of the body 12 with alternating lid and body knuckles 34, 36 that have axially aligned openings sized to receive a replaceable metal rod 38. This provides an extraordinarily durable hinge, while allowing the lid 14 and body 12 to be separated for repair or replacement.

The lid 14 may be secured in a closed position by use of elastomeric draw latches 40. One end of the elastomeric latch arm 42 may be secured to the lid 14, for example, and may be stretched by using a handle portion 44 to engage the latch arm 42 with a cleat mounted in a corresponding position on the body 12. Such a closure devise is particularly durable and can survive high impact without damage, while being easily replaceable, if necessary. The latch arm 42 may be attached to the lid 14 such as with an anchor member 48 by use of screws or rivets 50. In this manner, the latch arm 42 is allowed to pivot relative to the lid 14, allowing it to be moved out of the way and not hamper easy opening and closing of the lid 14.

The unit 10 may be secured against tampering or contamination by providing a pair of aligned eyes 52, 54 on the lid 14 and body 12 to receive an elongated shank padlock 56. As shown in FIG. 1, recesses may be provided adjacent the attachment eyes 52, 54 to allow a padlock 56 to rest within the overall profile of the unit 10 without projecting outwardly therefrom where it may be susceptible to damage. Alternatively, single use ties or other tamper-evident security devices (not shown) may be used to lock the unit 10 through the eyes 52, 54 and control access.

According to another aspect of the invention, the body 12 and lid 14 may include a variety of molded openings, contours and/or indentations that facilitate utilization of strapping, lashing, or hook devices to secure the unit 10 in place to hold the unit 10 down or laterally against a support surface on a building, vehicle or support stand. For example, the lid 14 may be provided with left and right edge guide notches or indentations 58 which help hold a strap (not shown) in place without sliding when used to latch the unit 10 to a support surface below it. Alternatively, the forward edge of the lid 14 and forward upper edge of the body 12 may be provided with edge guide notches or cuts 60, 62, also sized to engage standard cargo straps that may be provided in a front-to-rear orientation.

Additional features may be provided for securing the body portion 12 of the unit 10 in a way that allows the lid 14 to be opened while the unit 10 remains securely held in place. For example, a forward upper edge of the body 12 may be provided with a transverse groove or guideway 64, also sized to receive a common cargo securement strap. This guideway or groove 64 allows such a securement strap to be fixed in place under and without interfering with either the latches 40 or padlock 56.

Figure 3:
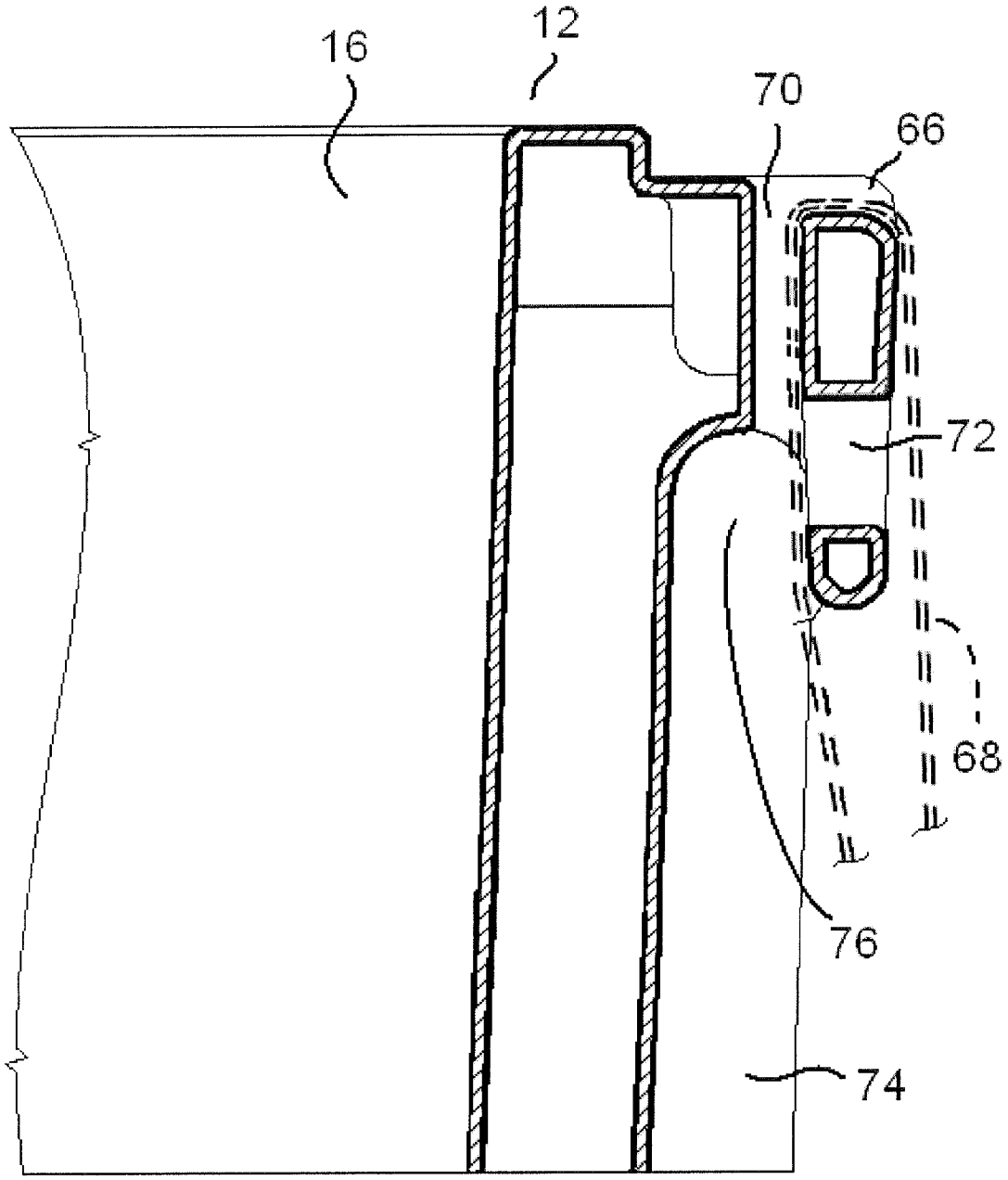
FIG. 3 is a fragmentary cross sectional view taken substantially along line 3-3 of FIG. 2.
Figure 4:
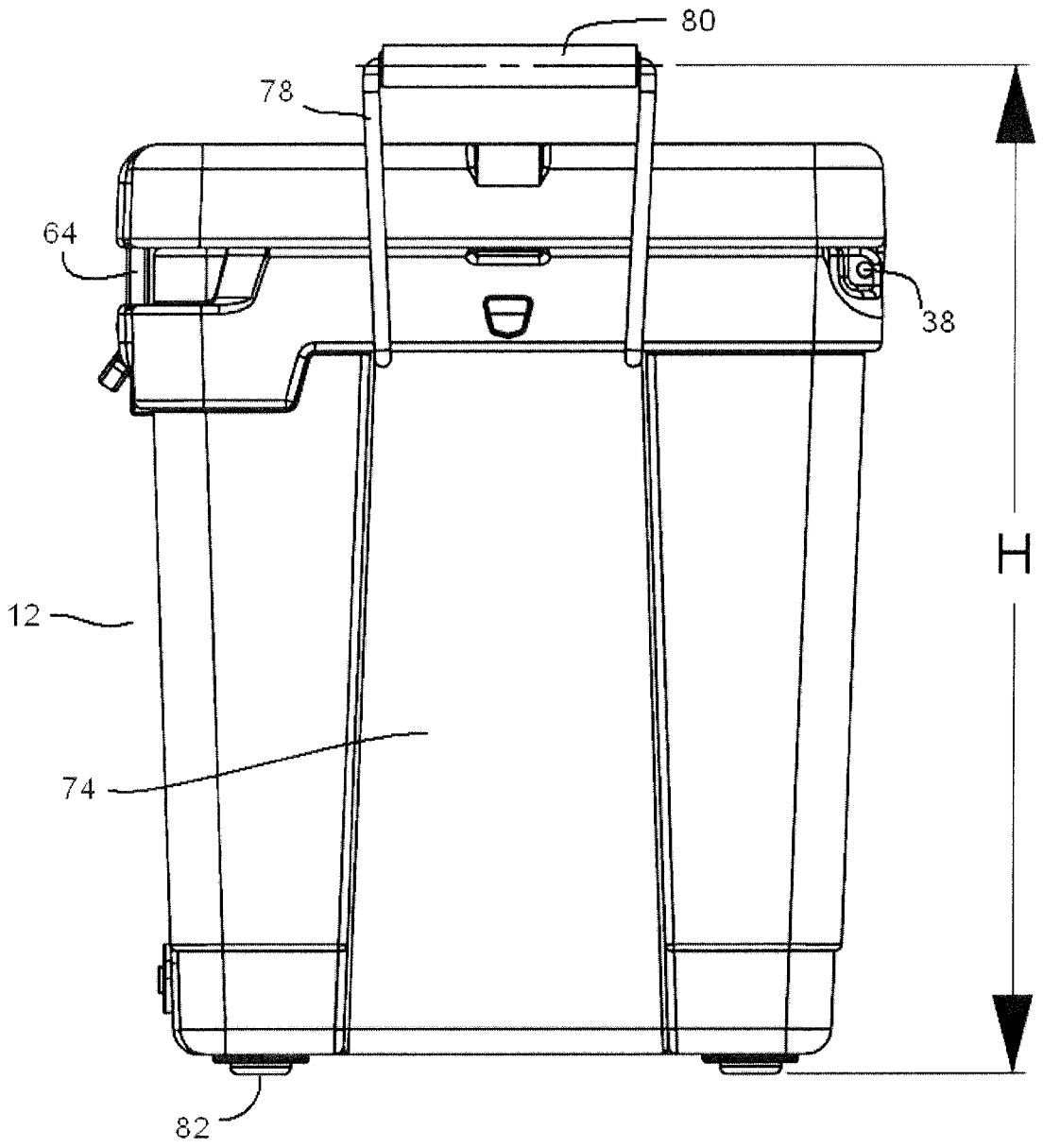
FIG. 4 is a right side plan view thereof with the rope handle in a lifted position.

Referring now in particular to FIGS. 1 and 4, upper side edges of the body 12 may be provided with guide indentations 66 for accommodating a tie down strap 68. A vertical passageway 70 is aligned with the guide indentation 66 to accept a tie-down strap 68, as illustrated in FIG. 3. Alternatively, hook openings 72 may be provided to receive tie-down hooks, such as on the end of an elastomeric cord.

Indentations 74 in sides of the body 12 provide two functions. First, as best illustrated in FIG. 3, the indentations 74 in combination with the upper extended edge where the vertical passageway 70 and hook opening 72 may be found, provide a recess 76 for receiving the fingers of a person lifting the unit 10. Additionally, as shown in FIGS. 1, 2, 5, and 16, flexible handles made by a combination of rope 78 and a rigid grip tube 80 provide handles that fall within the side recesses 74 when at rest. The rigid tube 80 may be made with a solid core and cushioned foam exterior to provide a comfortable and secure grip. When at rest, the rope handles 78, 80 are positioned in a flush alignment with the outside edges of the body 12 in the molded indentations 74. Referring now also to FIG. 4, therein can be seen that when the rope handles 78, 80 are lifted, a grip is provided at a selected height H above the bottom of the unit 10.

Elastomeric feet 82 may be provided on the outer bottom surface of the body 12 to resist sliding movement of the unit 10 on a support surface that may be wet, angled or subject to vibration.

Figure 5:
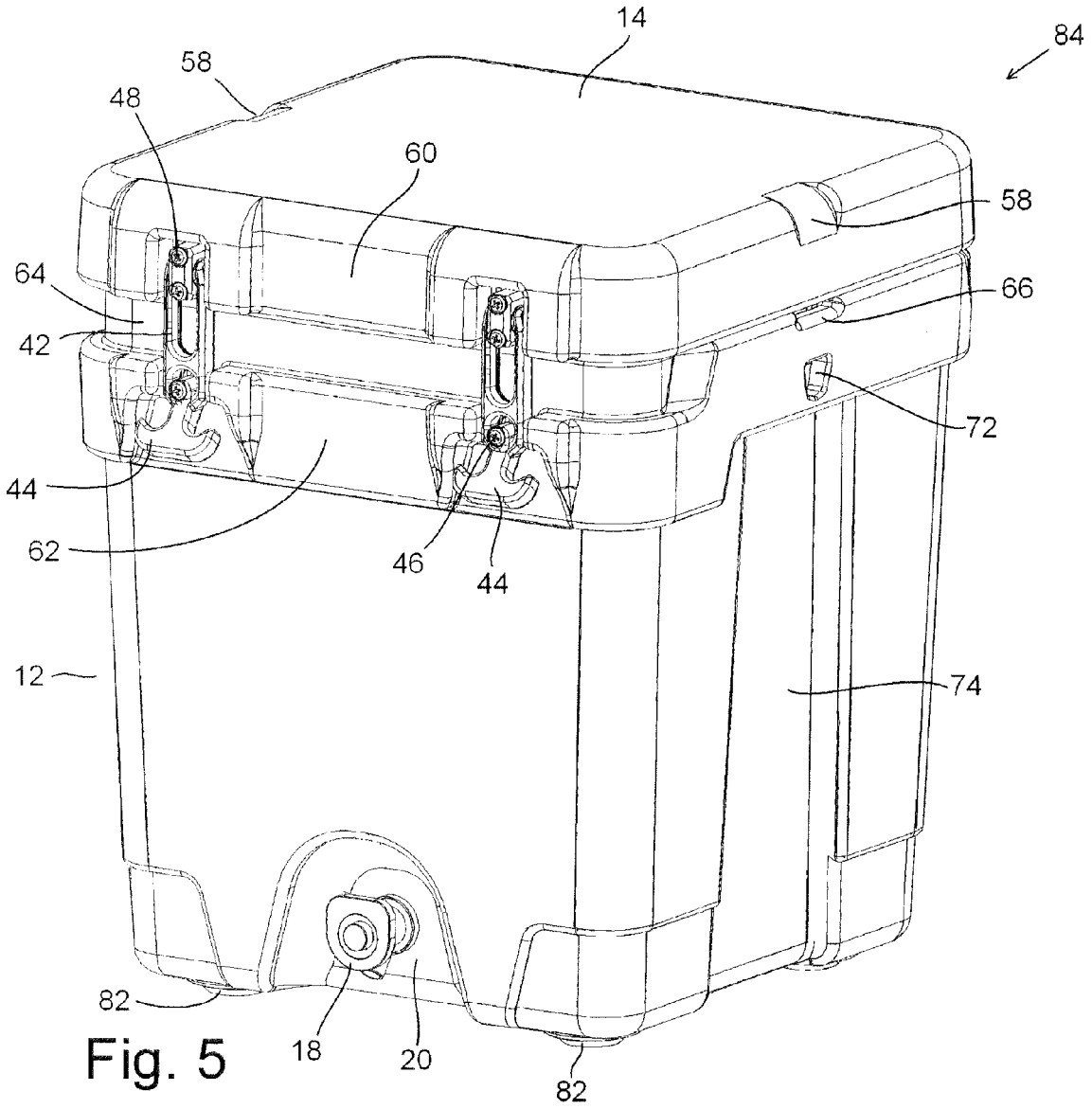
FIG. 5 is an isometric view of a second embodiment.
Figure 6:
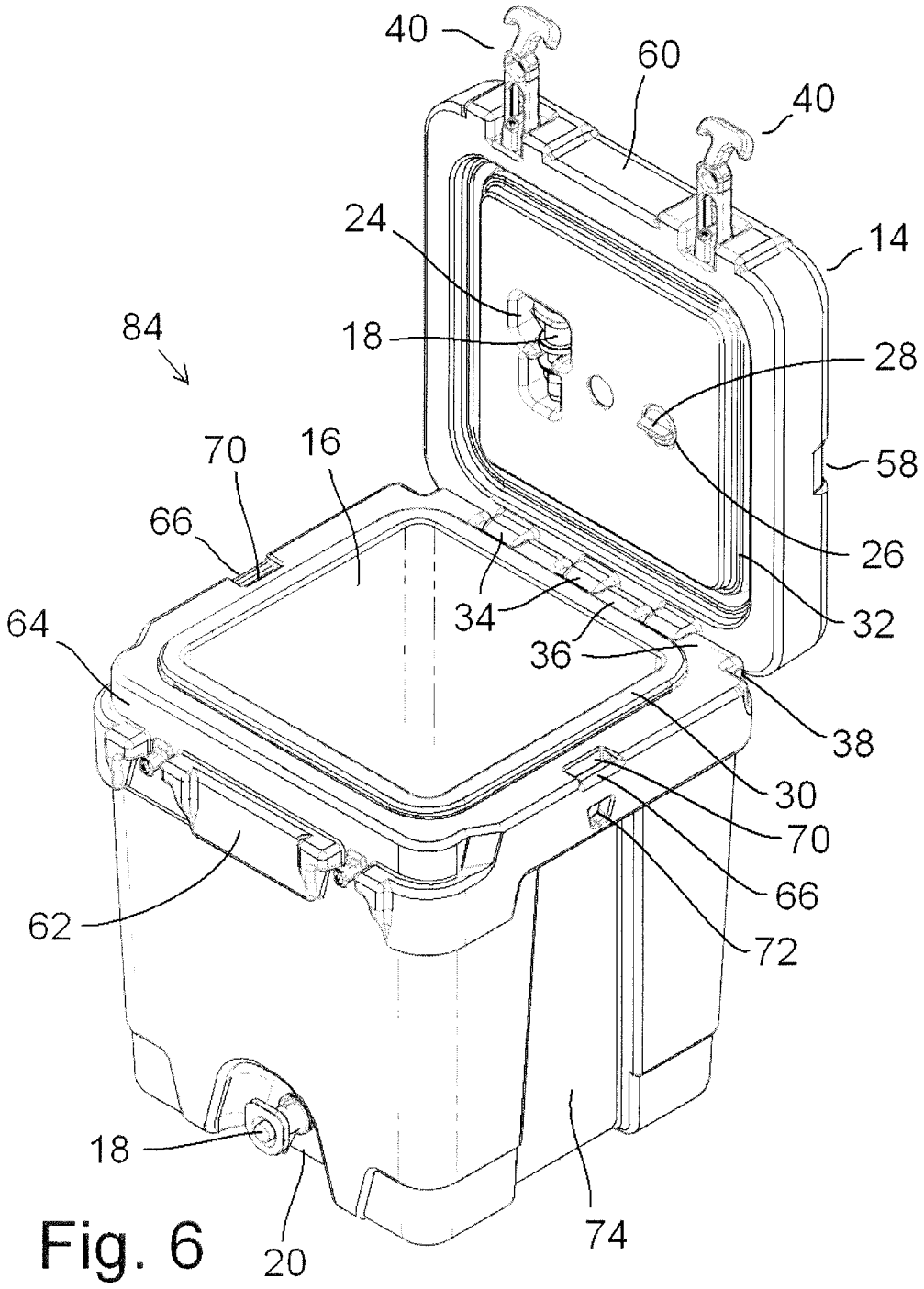
FIG. 6 is an isometric view thereof with the lid in an open position.

Referring now to FIGS. 5 and 6, therein is shown an insulated beverage dispenser and cooler 84 according to an alternate embodiment of the invention. This alternate embodiment may be of smaller capacity than the previously described unit 10, such as having an interior chamber 16 of approximately 20 quarts volume. Other than the overall size and capacity of the unit 84, it differs from the previously-described unit 10 minimally, in that it does not include rope handles or eyes for receiving a padlock. With those exceptions, like reference numerals are used to indicate corresponding parts and features throughout the use of this second embodiment.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. An insulated beverage dispenser, comprising:

a cube-shaped insulated body having four sidewalls, each sidewall having a width and being adjacent to two other sides, an interior chamber, an opening extending between and terminating at upper ends of the four sidewalls, and an outlet adjacent a bottom of the interior chamber;

a removable closure member for the outlet;

an insulated lid hingedly connected to an upper edge of one of the sidewalls of the body to close the opening;

a guideway on an outer surface of a first of the sidewalls of the body extending from one adjacent sidewall to a different adjacent sidewall, the guideway generally adjacent the upper end of the first sidewall and an edge of the opening, the guideway being sized and positioned to receive a securement strap extended across the body without interference with opening the lid; and lid latches positioned to secure the lid in a closed position, wherein the lid latches extend over the guideway.

2. The insulated beverage dispenser of claim 1, wherein the closure member is a liquid dispensing valve.

3. The insulated beverage dispenser of claim 1, wherein the closure member is a plug.

4. The insulated beverage dispenser of claim 1, wherein an interior surface of the lid includes at least one recess for receiving a spare closure member for the outlet.

5. The insulated beverage dispenser of claim 1, wherein the body includes first and second opposite tie-down passageways.

6. The insulated beverage dispenser of claim 1, wherein the lid includes a plurality of exterior edge notches positioned to guide a tie-down strap extended across the lid.

7. The insulated beverage dispenser of claim 1, further comprising left and right opposite carry handles.

8. The insulated beverage dispenser of claim 7, wherein the handles are integral with the body.

9. The insulated beverage dispenser of claim 7, wherein the handles include movable gripping portion that is extendable to a position above the lid.

10. The insulated beverage dispenser of claim 1, wherein the guideway extends on an outer surface of a second of the sidewalls of the body.

* * * * *